United States Patent [19]

Furåsen

[11] 4,129,426

[45] Dec. 12, 1978

[54] DEVICE FOR CLEANING WORKSHOP AIR

[75] Inventor: Willy Furåsen, Kungälv, Sweden

[73] Assignee: Flex Ake Wennberg AB, Karlstad, Sweden

[21] Appl. No.: 820,371

[22] Filed: Jul. 29, 1977

[30] Foreign Application Priority Data

Aug. 10, 1976 [SE] Sweden ..... 7608901

[51] Int. Cl.[2] ..... B01D 50/00

[52] U.S. Cl. ..... 55/217; 55/316; 55/323; 55/387; 55/472; 55/473; 55/482; 55/498

[58] Field of Search ..... 55/217, 323, 276, 279, 55/316, 418, 467, 387, 470–473, 482, 485, 498

[56] References Cited

U.S. PATENT DOCUMENTS

| | | | |
|---|---|---|---|
| 2,243,637 | 5/1941 | Landis et al. | 55/316 |
| 2,404,468 | 7/1946 | Vokes | 55/387 |
| 2,922,489 | 1/1960 | Hollingsworth | 55/217 |
| 3,224,171 | 12/1965 | Bowman | 55/407 |
| 3,766,844 | 10/1973 | Donnelly et al. | 55/316 |

*Primary Examiner*—Bernard Nozick

*Attorney, Agent, or Firm*—Cantor and Singer

[57] ABSTRACT

A device for cleaning the air in welding shops includes a casing surrounding a fan and an electric motor, a mechanical filter upstream of the fan and a filter including active carbon down-stream of the motor. In order to maintain a suitable temperature for the active carbon the air is brought to pass through, or around the motor. A thermal relay is provided to interrupt the current supply to the motor, should the temperature, due to clogging of the mechanical filter and resulting increase of the motor output, be raise to an impermissible level.

3 Claims, 1 Drawing Figure

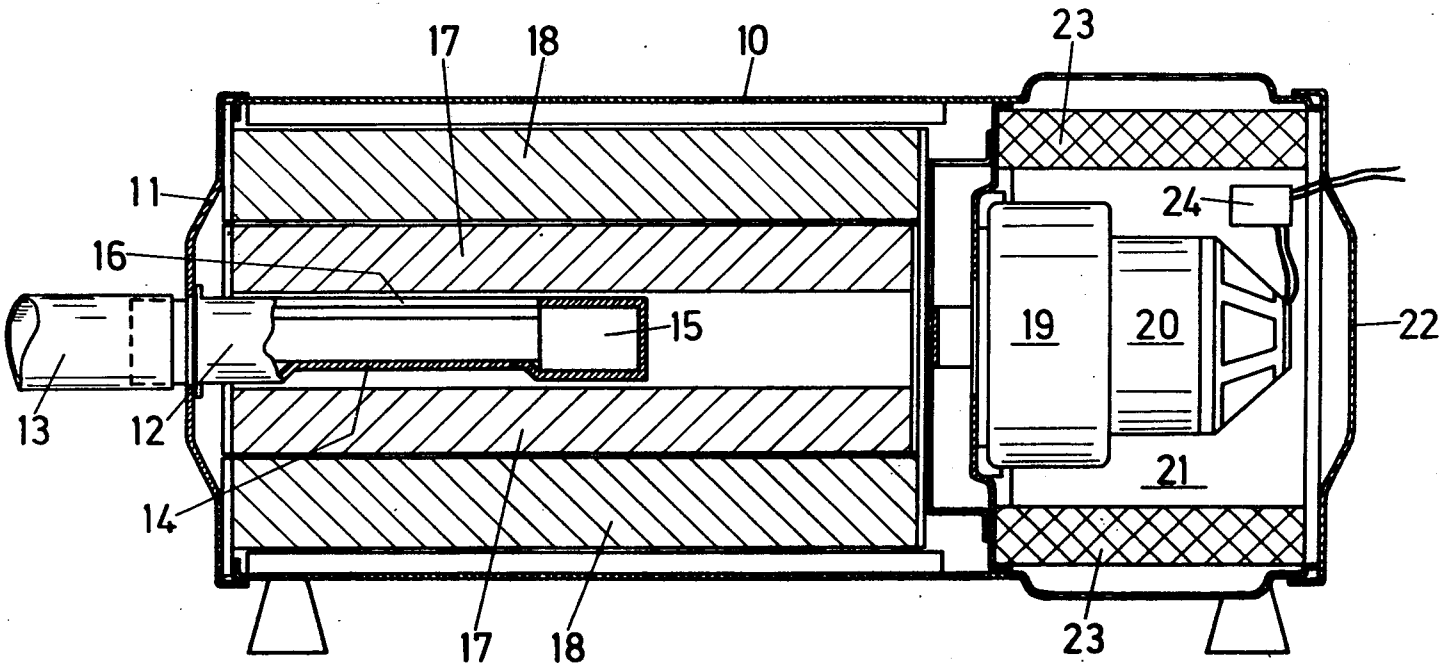
22
24
20
21
23
23
19
10
15
18
18
17
17
11
16
12
14
13

DEVICE FOR CLEANING WORKSHOP AIR

BACKGROUND OF THE INVENTION

During welding operations of different kinds considerable difficulties are encountered in connection with the smoke generated, and which largely can be attributed to the composition of the electrode coatings or to the flux being used. If the metal components, upon which welding is to be performed, have been painted, for instance with shop-primer, or if they have been galvanized, the problems will be increased, as the smoke can then contain nitrous gases, carbon-hydrochloric compounds, phosgene, and/or zinc salts. Such components are highly obnoxious and cannot be removed by passing the smoke through mechanical filters.

The aim of the present invention is to propose a simple and efficient device, which is well adapted to be applied at such local gas handling plants, where the smoke is collected and cleaned close by the welding spot where the smoke is generated. The device is designed as a lightweight movable unit, but may, of course, be built as a bigger stationary unit, as the need may be.

SUMMARY OF THE INVENTION

An important feature of the cleaning process is the use of active carbon. To function efficiently such carbon requires a certain operating temperature, and according to the invention the suitable conditions for maintaining such temperature are now provided. The invention refers to an air cleaning device including filter means, a fan and a motor driving the same as well as a casing through which the air to be cleaned is brought to pass and is characterized in that at least one mechanical filter is fitted upstream of the fan, that the latter, in a manner known per se, is located in relation to its driving motor that at least a substantial part of the air set into motion is made to pass through, or around the motor, and that a filter containing active carbon is fitted downstream of the motor.

The device is preferably provided with a thermal relay, located adjacent to the motor and adapted to interrupt the supply of electric current to the motor if the temperature downstream of the motor exceeds a predetermined value.

BRIEF DESCRIPTION OF THE DRAWING

The accompanying drawing shows, by way of example, a longitudinal section through a portable cleaning device according to the invention.

DESCRIPTION OF A PREFERRED EMBODIMENT

The device comprises a substantially cylindrical casing 10, which at one end 11 is provided with an inlet 12 having means for attaching a suction hose 13, which is extendable to a spot adjacent to where the welding is to be performed.

A tubular member 14 extends from the inlet, axially inwards through part of casing 10 and is terminated by a separation chamber 15. This will catch bigger particles and will also serve as a spark extinguisher, which is important with respect to the material commonly used in the filters.

The tubular member is along its upwardly turned face provided with an elongate exhaust slot 16. By removing hose 13 and turning the casing to an upright position it is possible, intermittently, to remove the particles collected in chamber 15.

Two filter packages 17 and 18 are provided, concentrically with respect to tubular member 14. These filter packages are preferably manufactured from folded paper, and are of a well known type. The outer filter package 18 being designed to catch particles being so small as to pass through the inner filter package 17.

From an annular passage surrounding the filter packages the air is directed inwards and is first made to pass a fan 19 and an electric motor 20 driving the same. The fan and its motor are mounted in a chamber 21, being accessible from the end 22 of the casing remote from the inlet end. This chamber is surrounded by filter means containing active carbon.

Such carbon will operate most favourably if the surrounding atmosphere is maintained at a certain, elevated temperature. On this occasion all the air handled by the fan will pass through the motor, but it may, on occasions, be advantageous to permit some of the air to pass outside the motor. The active carbon should preferably be permitted to operate at least at 30° C. and the capacity of the motor is selected so with respect to the resistance to flow offered by the suction hose 13 and the filter packages, that such temperature will be maintained in chamber 21.

The filter packages 17 and 18 will gradually become clogged by the dust particles collected therein, and this means that the resistance to flow, and thus the work extracted from the motor will increase. Active carbon will lose its efficiency at temperatures exceeding 70° C., and therefore a thermal relay 24 is provided in chamber 21, which breakes the supply of current to the motor when the temperature approaches this temperature. This will, at the same time, be an indication that it is now time to clean or to renew filter packages 17 and 18.

The efficiency of carbon filters 23 may be easily checked by removing the filters and weighing the same. As the mechanical cleaning is performed upstream of the fan, an increased weight will not indicate an addition of dust, but a change in the consistency of the active carbon.

The device may be modified in many ways within the scope of the appended claims. The fan may thus be fitted downstream of the motor, and the number and the type of the mechanical filters will have to be adapted to the actual cleaning requirements.

What I claim is:

1. A device for cleaning workshop air comprising:

(a) a casing having an inlet at one end thereof and an outlet at the other end thereof;

(b) means for separating and collecting large particles and arresting sparks located at the inlet end of the casing;

(c) a fan and an electric motor driving the same located at the outlet end of the casing;

(d) a mechanical filter located within said casing downstream of and communicating with said spark arresting means and upstream of said fan;

(e) filter means containing active carbon located at the outlet end of the casing downstream of said motor; and (f) conduit means within said casing for directing air from said mechanical filter to said fan past said motor to said active carbon-containing filter means;

(g) whereby the air being filtered, after passing through said spark arresting means and said mechanical filter and said fan, is heated by passing over said motor before passing through said active carbon-containing filter means.

2. The air cleaning device according to claim 1, further including a thermal relay, means for mouting said relay adjacent to the motor interrupting the supply of electric current to the motor if the temperature downstream of the motor exceeds a predetermined value.

3. The air cleaning device according to claim 1, said spark arresting means comprising a tubular member extending axially through part of said casing from the inlet end thereof and a collecting chamber having a sidewardly directed outlet at the inward end of said tubular member, the mechanical filter including at least one filter package of porous material arranged concentrically with said tubular member, said device further including means for mounting the fan and its motor in alignment with the tubular member, and a transverse wall for partly screening said fan and said motor from said first filter and said tubular member.

* * * * *